US010509430B2

(12) United States Patent
Wang

(10) Patent No.: US 10,509,430 B2
(45) Date of Patent: Dec. 17, 2019

(54) REFERENCE CIRCUITS

(71) Applicant: BOE Technology Group Co., Ltd., Beijing (CN)

(72) Inventor: Tangxiang Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/566,121

(22) PCT Filed: Mar. 22, 2017

(86) PCT No.: PCT/CN2017/077669
§ 371 (c)(1),
(2) Date: Oct. 12, 2017

(87) PCT Pub. No.: WO2017/202123
PCT Pub. Date: Nov. 30, 2017

(65) Prior Publication Data

US 2018/0173266 A1 Jun. 21, 2018

(30) Foreign Application Priority Data

May 26, 2016 (CN) ..... 2016 1 0363419

(51) Int. Cl.
*G05F 3/16* (2006.01)
*G05F 1/565* (2006.01)
*G05F 3/30* (2006.01)

(52) U.S. Cl.
CPC ..... *G05F 3/16* (2013.01); *G05F 1/565* (2013.01); *G05F 3/30* (2013.01)

(58) Field of Classification Search
CPC ..... G05F 3/16; G05F 3/20; G05F 3/26; G05F 3/267; G05F 3/30
See application file for complete search history.

(56) References Cited

U.S. PATENT DOCUMENTS 4,849,684 A * 7/1989 Sonntag ..... G05F 3/267 323/313
5,936,392 A * 8/1999 Taylor ..... G05F 3/267 323/315

(Continued)

FOREIGN PATENT DOCUMENTS

CN 101763136 A 6/2010
CN 101995898 A 3/2011

(Continued)

OTHER PUBLICATIONS

Second Office Action from Chinese Patent Application No. 201610363419.2, dated Nov. 16, 2017, 17 pages.

(Continued)

*Primary Examiner* — Fred E Finch, III
(74) *Attorney, Agent, or Firm* — Westman, Champlin & Koehler, P.A.

(57) ABSTRACT

The embodiments of the present disclosure disclose a reference circuit, comprising a current control sub-circuit, a voltage control sub-circuit and a voltage adjustment sub-circuit, wherein the current control sub-circuit outputs current to a first terminal and a second terminal of the voltage control sub-circuit and a first terminal of the voltage adjustment sub-circuit at a ratio of 1:1:n respectively, and the first terminal and the second terminal of the voltage control sub-circuit may cause a voltage at a second terminal of the voltage adjustment sub-circuit to be equal to a voltage at a third terminal of the voltage adjustment sub-circuit upon receiving equal current output by the current control sub-circuit, and the voltage adjustment sub-circuit may adjust a voltage output at an output terminal of the reference circuit to be independent of a temperature when the voltage at the second terminal is equal to the voltage at the third terminal.

6 Claims, 3 Drawing Sheets

(56) References Cited

U.S. PATENT DOCUMENTS 6,188,270 B1* 2/2001 Boerstler ..... G05F 3/267 323/315
6,351,111 B1* 2/2002 Laraia ..... G05F 3/267 323/315
2002/0140498 A1* 10/2002 Pernici ..... G05F 3/30 327/540
2003/0020535 A1* 1/2003 Young ..... G05F 3/267 327/538
2003/0132796 A1* 7/2003 Gailhard ..... G05F 3/267 327/543
2005/0140428 A1* 6/2005 Tran ..... G05F 3/30 327/539
2006/0164158 A1* 7/2006 Kimura ..... G05F 3/30 327/539
2007/0080741 A1* 4/2007 Yeo ..... G05F 3/30 327/539
2007/0210784 A1* 9/2007 Sung ..... G05F 3/30 323/316
2008/0157746 A1 7/2008 Chen
2008/0164937 A1* 7/2008 Kim ..... G05F 3/30 327/539
2009/0066313 A1* 3/2009 Kimura ..... G05F 3/262 323/313
2009/0251203 A1* 10/2009 Kimura ..... G05F 3/267 327/538
2010/0214013 A1* 8/2010 Shibayama ..... G05F 3/30 327/539
2012/0098506 A1* 4/2012 Hu ..... G05F 3/262 323/265
2013/0057246 A1* 3/2013 Satoh ..... G05F 3/30 323/313
2014/0077789 A1* 3/2014 Hu ..... G05F 3/30 323/313

FOREIGN PATENT DOCUMENTS

CN 102654780 A 9/2012
CN 203870501 U 10/2014
CN 105955388 A 9/2016
TW 200827978 A 7/2008

OTHER PUBLICATIONS

International Search Report and Written Opinion, and English Translation of International Search Report and Box V of the Written Opinion from International Patent Application No. PCT/CN2017/077669, dated Jun. 29, 2017, 20 pages.
First Office Action from Chinese Patent Application No. 201610363419.2, dated Mar. 13, 2017, 14 pages.

* cited by examiner

REFERENCE CIRCUITS

CROSS-REFERENCE TO RELATED APPLICATION(S)

The present application is a National Stage Application of PCT Application No. PCT/CN2017/077669, which claims priority to the Chinese Patent Application No. 201610363419.2, filed on May 26, 2016, entitled "REFERENCE CIRCUITS," which is incorporated herein by reference in its entirety.

TECHNICAL FIELD

The present disclosure relates to the field of integrated circuit technology, and more particularly, to a reference circuit.

BACKGROUND

In a conventional integrated circuit, a supply voltage is susceptible to an ambient temperature. The supply voltage changes with the ambient temperature, which may directly or indirectly affect the performance of the entire integrated circuit.

Therefore, there is a need for a reference circuit to provide an integrated circuit with a voltage which is substantially not affected by the ambient temperature.

SUMMARY

The embodiments of the present disclosure provide a reference circuit, comprising:

a current control sub-circuit;

a voltage control sub-circuit; and a voltage adjustment sub-circuit, wherein the current control sub-circuit has a first terminal connected to a first level signal terminal, a second terminal connected to a first terminal of the voltage control sub-circuit, a third terminal connected to a second terminal of the voltage control sub-circuit and a fourth terminal connected to a first terminal of the voltage adjustment sub-circuit and an output terminal of the reference circuit, and the current control sub-circuit is configured to output current to the first terminal and the second terminal of the voltage control sub-circuit and the first terminal of the voltage adjustment sub-circuit at a ratio of 1:1:n respectively, where n is a positive number;

the voltage control sub-circuit has a third terminal connected to a second terminal of the voltage adjustment sub-circuit and a fourth terminal connected to a third terminal of the voltage adjustment sub-circuit, and the voltage control sub-circuit outputs equal voltages to the second terminal and the third terminal of the voltage adjustment sub-circuit respectively; and the voltage adjustment sub-circuit is configured to adjust a voltage output at the output terminal of the reference circuit so that the voltage output at the output terminal is independent of a temperature.

According to an embodiment of the present disclosure, the voltage adjustment sub-circuit comprises a first triode, a second triode, a first resistor, a second resistor and a third resistor, wherein one terminal of the first resistor and one terminal of the second resistor are connected to a first node respectively, the other terminal of the first resistor is connected to an emitter of the first triode, and the other terminal of the second resistor is connected to the ground;

the third resistor has one terminal connected to the fourth terminal of the current control sub-circuit and the output terminal respectively and the other terminal connected to the ground; and a base and a collector of the first triode and a base and a collector of the second triode are connected to the ground respectively, and an emitter of the second triode is connected to the fourth terminal of the voltage control sub-circuit.

According to an embodiment of the present disclosure, the voltage adjustment sub-circuit further comprises a fourth resistor having one terminal connected to a second node and other terminal connected to the ground.

According to an embodiment of the present disclosure, the second resistor has a resistance value equal to a resistance value of the fourth resistor.

According to an embodiment of the present disclosure, the voltage control sub-circuit comprises a first transistor and a second transistor, wherein the first transistor has a gate connected to a gate and a drain of the second transistor respectively, a source connected to the first node and a drain connected to the second terminal of the current adjustment sub-circuit; and the second transistor has a source connected to the second node.

According to an embodiment of the present disclosure, both of the first transistor and the second transistor are N-type transistors.

According to an embodiment of the present disclosure, the current control sub-circuit comprises a third transistor, a fourth transistor and a fifth transistor, wherein a gate and a drain of the third transistor, a gate of the fourth transistor and a gate of the fifth transistor are connected to the drain of the first transistor respectively, and a source of the third transistor, a source of the fourth transistor and a source of the fifth transistor are connected to the first level signal terminal respectively;

the fourth transistor has a drain connected to the gate and the drain of the second transistor and the gate of the first transistor respectively; and the fifth transistor has a drain connected to the output terminal.

According to an embodiment of the present disclosure, all of the third transistor, the fourth transistor and the fifth transistor are P-type transistors.

DETAILED DESCRIPTION

Hereinafter, specific implementations of the reference circuit according to the embodiments of the present disclosure will be described in detail with reference to the accompanying drawings.

Figure 1:
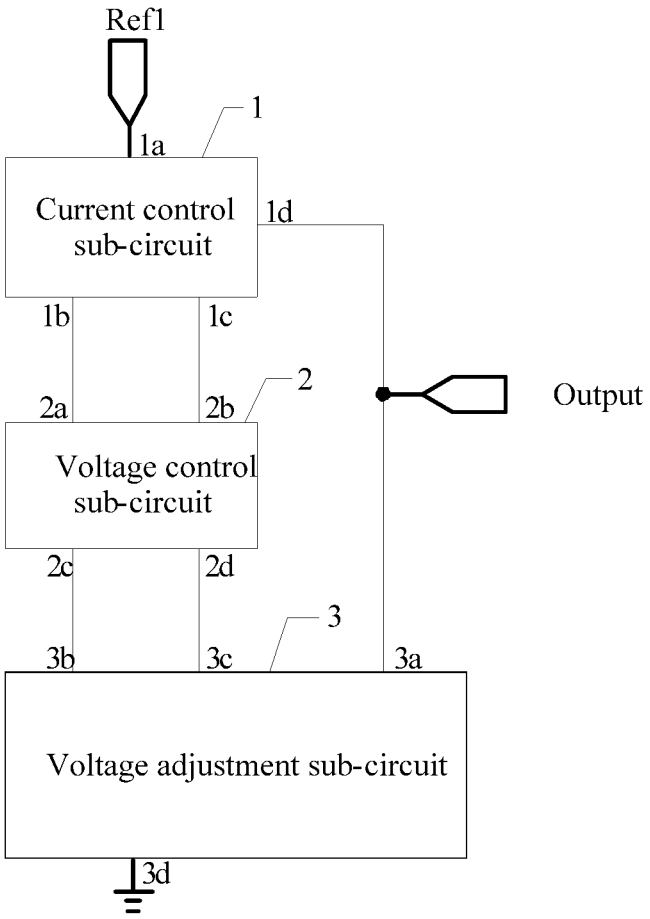
FIG. 1 is a structural diagram of a reference circuit according to an embodiment of the present disclosure.

The embodiments of the present disclosure provide a reference circuit, as shown in FIG. 1, comprising a current control sub-circuit 1, a voltage control sub-circuit 2 and a voltage adjustment unit 3. The current control sub-circuit 1 has a first terminal 1*a* connected to a first level signal terminal Ref1, a second terminal 1*b* connected to a first terminal 2*a* of the voltage control sub-circuit 2, a third terminal 1*c* connected to a second terminal 2*b* of the voltage control sub-circuit 2 and a fourth terminal 1*d* connected to a first terminal 3*a* of the voltage adjustment sub-circuit 3 and an output terminal Output of the reference circuit respectively. The current control sub-circuit 1 is configured to output current to the first terminal 2*a* and the second terminal 2*b* of the voltage control sub-circuit 2 and the first terminal 1*a* of the voltage adjustment sub-circuit 3 at a ratio of 1:1:n respectively, where n is a positive number.

The voltage control sub-circuit 2 has a third terminal 2*c* connected to a second terminal 3*b* of the voltage adjustment sub-circuit 3 and a fourth terminal 2*d* connected to a third terminal 3*c* of the voltage adjustment sub-circuit 3. The voltage control sub-circuit 2 is configured to output equal voltages to the second terminal 3*b* and the third terminal 3*c* of the voltage adjustment sub-circuit 3 respectively.

The voltage adjustment sub-circuit 3 is configured to adjust a voltage output at the output terminal Output to be independent of a temperature.

According to the reference circuit according to the embodiments of the present disclosure, the current control sub-circuit outputs equal current to the first terminal and the second terminal of the voltage control sub-circuit respectively, and the first terminal and the second terminal of the voltage control sub-circuit can cause the voltage at the second terminal of the voltage adjustment sub-circuit to be equal to the voltage at the third terminal of the voltage adjustment sub-circuit upon receiving the equal current output from the current control sub-circuit. The voltage adjustment sub-circuit can adjust the voltage output at the output terminal of the reference circuit to be independent of the temperature when the voltage at the second terminal is equal to the voltage at the third terminal. In this way, the reference circuit can provide the integrated circuit with a voltage which is substantially not affected by the temperature, which can optimize the performance of the entire integrated circuit.

For example, the voltage at the first level signal terminal Ref1 may be a positive voltage.

Figure 2:
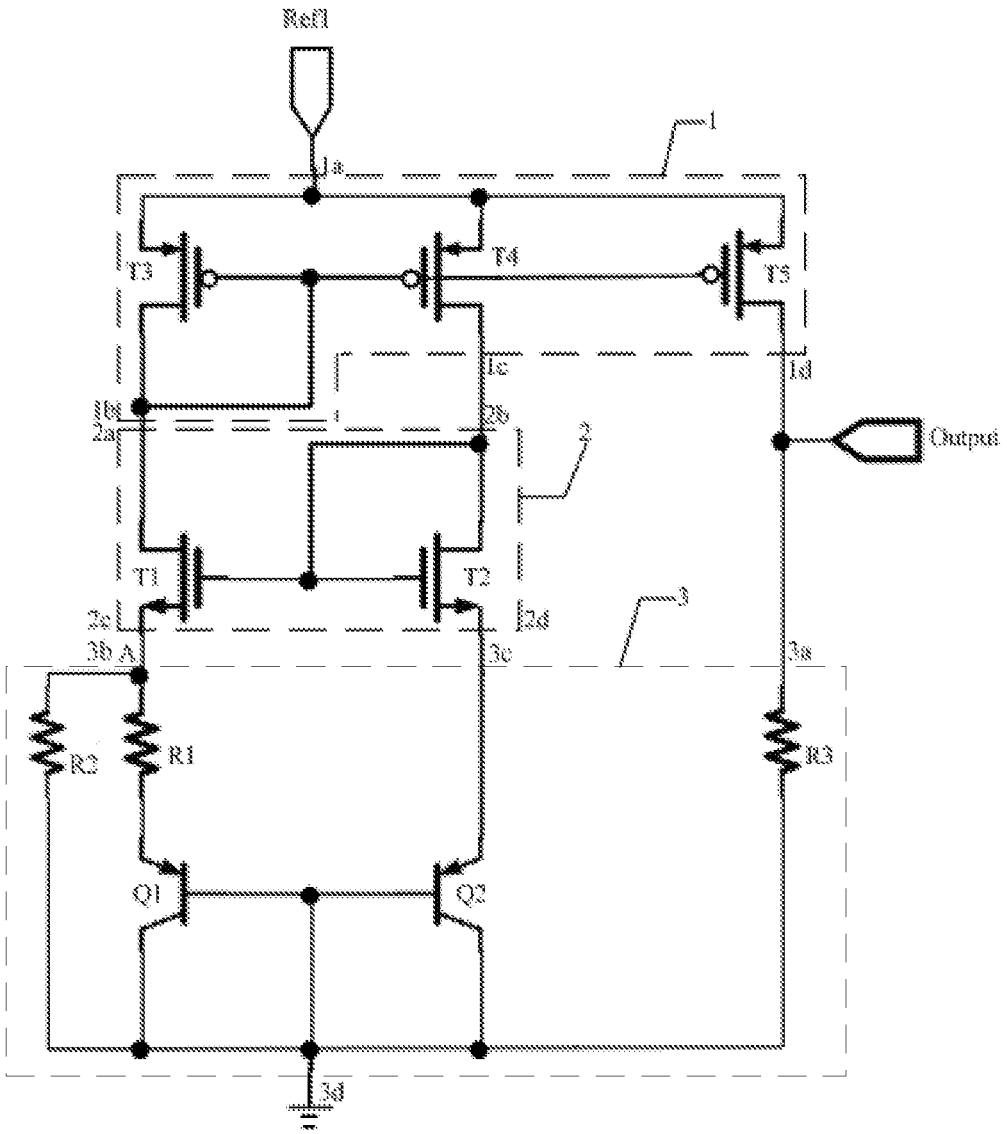
FIG. 2 is an exemplary structural diagram of a reference circuit according to an embodiment of the present disclosure.

As shown in FIG. 2, the voltage adjustment sub-circuit 3 may comprise a first triode Q1, a second triode Q2, a first resistor R1, a second resistor R2 and a third resistor R3, wherein one terminal of the first resistor R1 and one terminal of the second resistor R2 are connected to a first node A respectively, the other terminal of the first resistor R1 is connected to an emitter of the first triode Q1, and the other terminal of the second resistor R2 is connected to the ground; the third resistor R3 has one terminal connected to the fourth terminal 1*d* of the current control sub-circuit 1 and the output terminal Output respectively and the other terminal connected to the ground; and a base and a collector of the first triode Q1 and a base and a collector of the second triode Q2 are connected to the ground respectively, and an emitter of the second triode Q2 is connected to the fourth terminal 2*d* of the voltage control sub-circuit 2.

When the voltage adjustment sub-circuit 3 uses the first triode Q1, the second triode Q2, the first resistor R1, the second resistor R2 and the third resistor R3, the first resistor R1 and the first triode Q1 are connected in series and are then connected in parallel with the second triode Q2, a voltage $V_{R1}$ across the first resistor R1 is a difference between a base-emitter junction voltage $V_{be2}$ of the second triode Q2 and a base-emitter junction voltage $V_{be1}$ of the first triode Q1, i.e., $V_{R1}=V_{be2}-V_{be1}$. A triode satisfies a formula $I_C=I_S\times\exp[V_{be}/V_t]$, wherein $I_C$ is collector current, $I_S$ is saturation current, $V_{be}$ is a base-emitter junction voltage, and $V_t$ is a thermal voltage, and $V_t$=kT/q, wherein k is a Boltzmann constant which is k=1.38×10-23 J/K, T is a thermodynamic temperature, i.e., an absolute temperature which is T=300K during a normal temperature, and q is an amount of electron charges which is q=1.6×10-19 C. Therefore, it may be deduced that the voltage across the first resistor R1 is $$V_{R1} = V_{be2} - V_{be1} = V_t \ln\frac{I_{C2}}{I_{S2}} - V_t \ln\frac{I_{C1}}{I_{S1}} = V_t \ln\frac{I_{C2}I_{S1}}{I_{S2}I_{C1}},$$

and it is assumed that an area of the emitter of the second triode Q2 is N times of an area of the emitter of the first triode Q1, saturation current $I_{S2}$ of the second triode Q2 is $$\frac{1}{N}$$

of saturation current of the first triode Q1, and then the above formula may be simplified as $$V_{R1} = V_t \ln\frac{NI_{C2}}{I_{C1}}.$$

It can be seen that current on the first resistor R1 is $$I_{R1} = \frac{V_{R1}}{R1} = \frac{V_t}{R1}\ln\frac{NI_{C2}}{I_{C1}},$$

the second resistor R2 is connected in parallel with the second triode Q2, a voltage $V_{R2}$ across the second resistor R2 is equal to the base-emitter junction voltage $V_{be2}$ of the second triode Q2, and current on the second resistor R2 is $$I_{R2} = \frac{V_{R2}}{R2} = \frac{V_{be2}}{R2}.$$

Current output from the current control sub-circuit 1 to the first terminal 2*a* of the voltage control sub-circuit 2 is a sum of the current on the first resistor R1 and the current on the second resistor R2, i.e., $$\frac{V_t}{R1}\ln\frac{NI_{C2}}{I_{C1}} + \frac{V_{be2}}{R2}.$$

As the current output by the current control sub-circuit 1 to the first terminal 2*a* and the second terminal 2*b* of the voltage control sub-circuit 2 and the first terminal 3*a* of the voltage adjustment sub-circuit 3 respectively is at a ratio of 1:1:n, current output by the current control sub-circuit 1 to the first terminal 3*a* of the voltage adjustment sub-circuit 3, i.e., current on the third resistor R3, is $$n\left(\frac{V_t}{R1}\ln\frac{NI_{C2}}{I_{C1}}+\frac{V_{be2}}{R2}\right).$$

It can be seen that a voltage across the third resistor R3, i.e., the voltage output at the output terminal Output of the reference circuit, is $$V_{out}=n\left(\frac{R3}{R1}V_t\ln\frac{NI_{C2}}{I_{C1}}+\frac{R3}{R2}V_{be2}\right),$$

wherein $V_t$ is in a positive correlation relation with the temperature and $V_{be2}$ is in a negative correlation relation with the temperature. Therefore, resistance values of the first resistor R1, the second resistor R2 and the third resistor R3 can be designed so that the voltage output at the output terminal Output of the reference circuit is substantially not affected by the temperature. In addition, according to calculations and simulations, the voltage output at the output terminal of the reference circuit can be controlled at about 0.6V. Therefore, the reference circuit according to the embodiments of the present invention can further realize a low voltage output.

Figure 3:
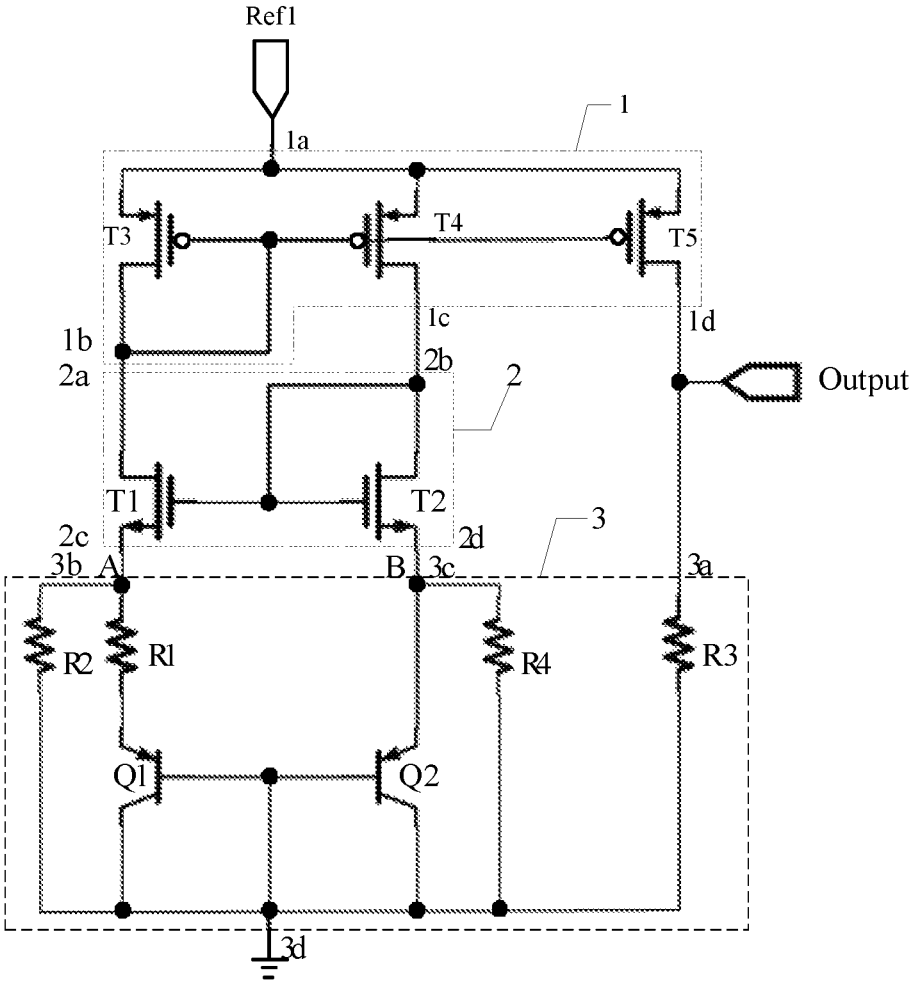
FIG. 3 is another exemplary structural diagram of a reference circuit according to an embodiment of the present disclosure.

As shown in FIG. 3, the voltage adjustment sub-circuit 3 may further comprise a fourth resistor R4 having one terminal connected to a second node B and other terminal connected to the ground. Thus, resistance values of the first resistor R1, the second resistor R2, the third resistor R3 and the fourth resistor R4 can be designed so that the voltage output at the output terminal Output of the reference circuit is substantially not affected by the temperature.

For example, when the resistance values of the first resistor R1, the second resistor R2, the third resistor R3 and the fourth resistor R4 are designed so that the voltage output at the output terminal Output of the reference circuit is substantially not affected by the temperature, the resistance value of the second resistor R2 may be maintained to be equal to the resistance value of the fourth resistor R4. Thus, it can be ensured that the current on the second resistor R2 is equal to the current on the fourth resistor, so that collector current of the first triode Q1 is equal to collector current of the second triode Q2, i.e., $I_{C1}=I_{C2}$. In this way, the voltage output at the output terminal Output of the reference circuit can be simplified as $$V_{out}=n\left(\frac{R3}{R1}V_t\ln N+\frac{R3}{R2}V_{be2}\right).$$

For example, the first resistor R1, the second resistor R2, the third resistor R3 and the fourth resistor R4 may be resistors having fixed resistance values, and the resistance values of the first resistor R1, the second resistor R2, the third resistor R3 and the fourth resistor R4 are appropriately designed so that the voltage output at the output terminal Output of the reference circuit according to the embodiments of the present disclosure is substantially not affected by temperature. Alternatively, the first resistor R1, the second resistor R2, the third resistor R3 and the fourth resistor R4 may be resistors having adjustable resistance values, for example, variable resistors, and the resistance values of the first resistor R1, the second resistor R2, the third resistor R3 and the fourth resistor R4 are appropriately adjusted so that the voltage output at the output terminal Output of the reference circuit according to the embodiments of the present disclosure is substantially not affected by temperature. The present disclosure is not limited thereto.

As shown in FIG. 3, the voltage control sub-circuit 2 may comprise a first transistor T1 and a second transistor T2, wherein the first transistor T1 has a gate connected to a gate and a drain of the second transistor T2 respectively, a source connected to the first node A and a drain connected to the second terminal 1*b* of the current adjustment sub-circuit 1; and the second transistor T2 has a source connected to the second node B.

According to the embodiments of the present disclosure, when the voltage control sub-circuit 2 comprises the first transistor T1 and the second transistor T2, the current control sub-circuit 1 outputs equal current to the first terminal 2*a* and the second terminal 2*b* of the voltage control sub-circuit 2 respectively, i.e., the current control sub-circuit 1 outputs equal current to the drain of the first transistor T1 and the drain of the second transistor T2 respectively, that is, current of the first transistor T1 operating in a saturation region is equal to current of the second transistor T2 operating in a saturation region. Current of a transistor operating in a saturation region satisfies a formula $$I=\frac{1}{2}\mu_n C_{ox}\frac{W}{L}(V_{gs}-V_{th})^2,$$

where $\mu_n$ is an electron migration rate, $C_{ox}$ is capacitance of an active layer per sub-circuit area, $$\frac{W}{L}$$

is a width to length ratio of a channel, $V_{gs}$ is a voltage between a gate and a source and $V_{th}$ is a threshold voltage. Therefore, a voltage $V_{gs1}$ between the gate and the source of the first transistor T1 is equal to a voltage $V_{gs2}$ between the gate and the source of the second transistor T2, so that a voltage at the first node A may be equal to a voltage at the second node B, i.e., a voltage at the second terminal 3*b* of the voltage adjustment sub-circuit 3 is equal to a voltage at the third terminal 3*c* of the voltage adjustment sub-circuit 3. The voltage control sub-circuit 2 according to the embodiments of the present disclosure adopts a structure of the clamp circuit described above to realize output of equal voltages to the second terminal 3*b* and the third terminal 3*c* of the voltage adjustment sub-circuit 3 by using only two transistors. In this way, the structure of the reference circuit can be simplified, and the power consumption of the reference circuit can be reduced, thereby realizing a low voltage input to control the voltage at the first level signal terminal Ref1 to about 1.8V.

As shown in FIGS. 2 and 3, for example, both of the first transistor T1 and the second transistor T2 may be N-type transistors.

As shown in FIGS. 2 and 3, the current control sub-circuit 1 may comprise a third transistor T3, a fourth transistor T4 and a fifth transistor T5, wherein a gate and a drain of the third transistor T3, a gate of the fourth transistor T4 and a gate of the fifth transistor T5 are connected to the drain of the first transistor T1 respectively, and a source of the third transistor T3, a source of the fourth transistor T4 and a source of the fifth transistor T5 are connected to the first level signal terminal Ref1 respectively; the fourth transistor T4 has a drain of connected to the gate and the drain of the second transistor T2 and the gate of the first transistor T1 respectively; and the fifth transistor T5 has a drain connected to the output terminal Output.

When the current control sub-circuit 1 comprises the third transistor T3, the fourth transistor T4 and the fifth transistor T5, a structure of a mirror circuit is used, and when width to length ratios of the third transistor T3 and the fourth transistor T4 are equal and a ratio between width to length ratios of the third transistor T3 and the fifth transistor T5 are 1:n, current may be output to the first terminal 2*a* and the second terminal 2*b* of the voltage control sub-circuit 2 and the first terminal 3*a* of the voltage adjustment sub-circuit 3 at a ratio of 1:1:n.

As shown in FIGS. 2 and 3, all of the third transistor T3, the fourth transistor T4 and the fifth transistor T5 may be P-type transistors.

It should be noted that the transistors mentioned in the reference circuit according to the embodiments of the present disclosure may be a Metal Oxide Semiconductor (MOS) field effect transistors. The present disclosure is not limited thereto.

It will be apparent to those skilled in the art that various changes and variations can be made in the present disclosure without departing from the spirit and scope of the present disclosure. Thus, the present disclosure is intended to encompass such changes and variations if the changes and variations of the present disclosure are within the scope of the claims of the present disclosure and the equivalents thereof.

I claim:

1. A reference circuit, comprising:

a current control sub-circuit;

a voltage control sub-circuit; and a voltage adjustment sub-circuit, wherein the current control sub-circuit has a first terminal connected to a first level signal terminal, a second terminal connected to a first terminal of the voltage control sub-circuit, a third terminal connected to a second terminal of the voltage control sub-circuit and a fourth terminal connected to a first terminal of the voltage adjustment sub-circuit and an output terminal of the reference circuit, and the current control sub-circuit is configured to output current to the first terminal and the second terminal of the voltage control sub-circuit and the first terminal of the voltage adjustment sub-circuit at a ratio of 1:1:n, where n is a positive number;

the voltage control sub-circuit has a third terminal connected to a second terminal of the voltage adjustment sub-circuit and a fourth terminal connected to a third terminal of the voltage adjustment sub-circuit, and the voltage control sub-circuit is configured to output equal voltages to the second terminal and the third terminal of the voltage adjustment sub-circuit; and the voltage adjustment sub-circuit is configured to adjust a voltage output at the output terminal so that the voltage output at the output terminal is independent of a temperature;

wherein the current control sub-circuit comprises a third transistor, a fourth transistor and a fifth transistor, wherein a gate and a drain of the third transistor, a gate of the fourth transistor and a gate of the fifth transistor are connected to the first terminal of the voltage control sub-circuit, and a source of the third transistor, a source of the fourth transistor and a source of the fifth transistor are connected to the first level signal terminal;

wherein the fourth transistor has a drain connected to the second terminal of the voltage control sub-circuit;

wherein the fifth transistor has a drain connected to the output terminal; and wherein a width to length ratio of the third transistor and that of the fourth transistor are equal and a ratio between width to length ratios of the third transistor and the fifth transistor is 1:n, wherein the voltage adjustment sub-circuit comprises a first triode, a second triode, a first resistor, a second resistor and a third resistor, wherein one terminal of the first resistor and one terminal of the second resistor are connected to a first node, another terminal of the first resistor is connected to an emitter of the first triode, and another terminal of the second resistor is connected to ground;

the third resistor has one terminal connected to the fourth terminal of the current control sub-circuit and the output terminal and another terminal connected to the ground; and a base and a collector of the first triode and a base and a collector of the second triode are connected to the ground, and an emitter of the second triode is connected to the fourth terminal of the voltage control sub-circuit, each of the first resistor, the second resistor and the third resistor has an adjustable resistance value, and adjustable resistance values of the first resistor, the second resistor and the third resistor are designed so that the voltage output at the output terminal is $$n\left(\frac{R3}{R1}V_t\ln\frac{NI_{C2}}{I_{C1}}+\frac{R3}{R2}V_{be2}\right),$$

wherein $V_t$ is a thermal voltage, N is an area of the emitter of the second triode/an area of the emitter of the first triode, IC1 is a collector current of the first triode, IC2 is a collector current of the second triode, and $V_{be2}$ is a base-emitter junction voltage of the second triode.

2. The reference circuit according to claim 1, wherein the voltage adjustment sub-circuit further comprises a fourth resistor having a first terminal connected to a second node and a second terminal connected to the ground.

3. The reference circuit according to claim 2, wherein the second resistor has an adjustable resistance value which is equal to a resistance value of the fourth resistor.

4. The reference circuit according to claim 2, wherein the voltage control sub-circuit comprises a first transistor and a second transistor, wherein the first transistor has a gate connected to a gate and a drain of the second transistor, a source connected to the first node and a drain connected to the second terminal of the current control sub-circuit; and the second transistor has a source connected to the second node.

5. The reference circuit according to claim 4, wherein both of the first transistor and the second transistor are N-type transistors.

6. The reference circuit according to claim 1, wherein all of the third transistor, the fourth transistor and the fifth transistor are P-type transistors.

* * * * *